United States Patent [19]

Bruckner et al.

[11] Patent Number: 4,933,130

[45] Date of Patent: Jun. 12, 1990

[54] PRODUCTION OF SPIN-FINISH-FREE DRAWN FIBERS

[75] Inventors: Werner Bruckner, Kriftel; Peter Klein, Wiesbaden, both of Fed. Rep. of Germany

[73] Assignee: Hoechst Aktiengesellschaft, Frankfurt am Main, Fed. Rep. of Germany

[21] Appl. No.: 237,989

[22] Filed: Aug. 29, 1988

[30] Foreign Application Priority Data

Aug. 31, 1987 [DE] Fed. Rep. of Germany ..... 3729062

[51] Int. Cl.[5] ..... C23C 26/00

[52] U.S. Cl. ..... 264/129; 264/130; 264/210.2; 264/210.3; 264/210.8; 264/289.3; 264/290.5

[58] Field of Search ..... 264/134, 130, 129, 136, 264/210.2, 210.3, 210.1, 289.3, 290.5, 210.8; 427/175

[56] References Cited

U.S. PATENT DOCUMENTS

| | | | |
|---|---|---|---|
| 3,510,552 | 5/1970 | Tsuruta et al. | 264/289.3 |
| 3,619,461 | 11/1971 | Gay | 264/289.3 |
| 3,947,538 | 3/1976 | Marshall et al. | 264/210.7 |

FOREIGN PATENT DOCUMENTS

| | | | |
|---|---|---|---|
| 52-53976 | 4/1977 | Japan | 264/289.3 |

*Primary Examiner*—Hubert C. Lorin

[57] ABSTRACT

Process for producing spin-finish-free man-made fibers by melt spinning high polymers having a glass transition temperature of above 100° C. and subsequently drawing the filaments by means of preheater godets to a preset draw ratio, wherein the filaments are not spin-finished prior to drawing but are impinged with a liquid which can evaporate residuelessly during drawing and the temperature of the preheater godet is set not less than 40° C. higher than in the conventional process with spin finish application.

5 Claims, No Drawings

PRODUCTION OF SPIN-FINISH-FREE DRAWN FIBERS

DESCRIPTION

The present invention relates to the production of spin-finish-free man-made fibers having glass transition temperatures of above 100° C., from high polymers by melt spinning and subsequent drawing over heated godets.

An indispensable measure in the conventional production of man-made fibers and a prerequisite for most further processing operations, as for example the production of filament yarns, staple fibers and spun yarns, is the application of a suitable spin finish to the surface of the spun filaments. This spin finish has to perform very many, partly almost contradictory, functions in the course of production and processing, and those skilled in the art have expended much effort to find formulations which meet all these tasks to an optimal, balanced degree.

For instance, spin finishes are supposed to prevent the buildup of electrostatic charges on the filaments, reduce friction of filaments on yarn guides and also the filament/filament friction but at the same time also ensure sufficient interfilament adhesion for yarn cohesion without, however, for example in the production of staple fibers, preventing in any way the opening out of the filament packets, and last but not least they must ensure satisfactory drawing.

Customarily, man-made fibers are therefore provided with a spin finish immediately following melt spinning and even before any possible intermediate winding or drawing over heated godets. The substances and mixtures of substances which possess all the properties required of spin finishes to a high degree are generally applied to the filaments either as aqueous solutions or emulsions or without water, borne on mineral oil. The first application generally takes place from spin finish rolls or spin finish yarn guide elements even before or in the course of the first bringing together of the spun individual filaments. As the water or the volatile constituents of the mineral oil phase of the spin finish applied to the filaments evaporate in the course of the production process they leave behind on the filaments a coating which confers the required running properties on the filaments.

If the spin finish is not sufficiently effective, problems will generally occur straight away in the production stage immediately following the spin finish application stage, namely the drawing of the filaments. If the application of the spin finish is completely dispensed with, fibers cannot be produced in hitherto customary processes. Man-made fibers produced by prior art processes therefore always have an application of spin finish on their surface.

Specific fields of use, however, in contradistinction from the customary textile and non-textile uses, require man-made fibers without application of spin finish (man-made fibers is here to be understood as a generic term encompassing filaments, staple fibers and yarns). It is therefore necessary to wash the man-made fibers produced in a conventional manner afterwards with water (and added detergent) or with solvents in order to free them from the superficial application of spin finish. The complete removal of the spin finish from the fiber surface by such an aftertreatment is not only complicated, expensive and environmentally polluting but frequently also not completely possible at all, since at the high temperatures to which the man-made fibers are exposed during production spin finish constituents can become firmly bonded to the fiber surface or insoluble.

An important field of application of man-made fibers which is becoming ever more significant is their use for producing fiber-reinforced plastics. Specifically this use, however, requires finish-free fiber surfaces.

Even if the requirements of further processing into yarns for the textile sector make spin finished fibers desirable, it can be advantageous to keep the filaments free of spin finish until downstream of the last heated godet, because the production of spin finish vapors and the deposition of spin-finish residues on the heated godets is avoided. In this case, the spin finish can be applied between the last hot godet and the take-up means.

The present invention, then, provides a process for producing completely spin-finish-free man-made fibers of high molecular orientation having the accustomed textile data by producing these filaments from high polymers having a glass transition temperature of above 100° C. by melt spinning and subsequent drawing over heated godets to a preset draw ratio.

The process according to the invention comprises impingeing the filaments prior to drawing with a liquid which can evaporate residuelessly during drawing and selecting the temperature of the preheater godet not less than 40° C. higher than in the customary procedure involving spin finish.

Liquids which can evaporate residuelessly during drawing are those which have a boiling point within the range from about 80° to 220° C., preferably from 90° to 180° C. If an organic liquid is to be used, it would be convenient to select such a liquid as has a high ignition temperature and is easily and completely removable from the waste air and, ideally, recoverable.

Examples of such substances are aliphatic compounds of 2 to 8, preferably 3 to 6, carbon atoms containing OH and/or ether groups, such as alkanols, glycols, glycol monoethers or diglycol monoethers. A particularly preferred residuelessly evaporable liquid is water.

The process according to the invention is suitable in principle for producing man-made fibers from all known and conceivable melt-spinnable high polymers having a glass transition temperature of $>100°$ C.

Known melt-spinnable high polymers which have a glass transition temperature of above 100° C. (above 373° K.) and which are thus spinnable into undressed man-made fibers by the process according to the invention are found in many groups of polymeric substances and condensation polymers known from the relevant literature (for example Encyclopedia of Polymer Science and Engineering, John Wiley & Sons (1986), vol. 6, p. 707 to 725; Kirk-Othmer Encyclopedia of Chemical Technology, John Wiley & Sons, 3rd edition, vol. 18, p. 585 to 611; Ullmann's Encyclopadie der technischen Chemie, Verlag Chemie, Weinheim/Bergst., 4th edition, vol. 11, p. 206/207, 291 et seq.), for example in the groups of the polyesters and polyamides comprising predominantly aromatic building blocks, the wholly aromatic polyethers, the aromatic polyurethanes, the polyarylene sulfides, the polybenzimidazoles, the polyether ketones, the polyether sulfones and the polyether imides.

Industrially particularly useful high polymers which can be processed into undressed man-made fibers by the process according to the invention are those from the series of the polyether ketones, polyether sulfones and polyether imides.

By reference to the available literature (for example J. Brandrup, E. H. Immergut, Polymer Handbook, John Wiley & Sons (1975), tables pages III-139 to III-179) or by simple known analytical investigation it is possible to select from the abovementioned groups of melt-spinnable high polymers those whose glass transition temperature is higher than 100° C. In the same way the skilled worker can determine whether a melt-spinnable high polymer selected by him from other aspects has a glass transition temperature of >100° C. and thus is advantageously processable by the process according to the invention into undressed man-made fibers.

It was extremely surprising that such a technically simple method makes it possible to produce spin-finish-free man-made fibers without a complicated washing and cleaning process.

This is plain not only from the fact that, despite the evident economic absurdity of first applying a sophisticated spin finish to the fibers, then, after the fiber material has been produced, laboriously washing this spin finish off again and finally also making the wash liquor ecologically safe, hitherto no simpler way has been practised for the production of spin-finish-free man-made fibers, but also from considering the previous man-made fibermanufacturing process and observing the response thereof to changes in the processing conditions.

If conventionally spin-finished man-made fibers from melt-spinnable high polymers are to be drawn by means of pairs of godets (or by means of individual godets coordinated with displacing rollers), they are normally guided, prior to drawing, over a heated pair of godets and immediately thereafter over at least one further pair of godets whose surface speed is higher than that of the first pair of godets by the desired draw ratio and which may be heated. The skilled worker knows that, to obtain trouble-free drawing, the surface temperature of the first pair of godets must be set approximately within the order of magnitude of the glass transition temperature ($T_g$) of the polymer and must not be much higher than that temperature. If significantly higher surface temperatures are set, the drawing process is disturbed, because the yarn or individual elements become stuck to the godet surface. Nor is it possible at a surface temperature more than about 30° C. above the glass transition temperature of the polymer to obtain for a given draw ratio the same degree of orientation as is obtained with a surface temperature between $T_g$ and $T_g+30°$ C.

The temperature of the preheater godet at which satisfactory drawing of spin-finished fibers results additionally depends to a certain degree on the remaining processing conditions and on machine-specific factors. The godet temperature for drawing spin-finished fibers is therefore routinely optimized in the individual case.

If, in the production of spin-finish-free man-made fibers, in particular from high polymers having glass transition temperatures above 100° C., the customary spin finish (waterborne or, free of water, based on mineral oils) is replaced by a liquid which can evaporate residuelessly at the drawing temperature, for example pure water, it is found that with an unchanged setting on the drawing means the running properties deteriorate badly. The drawing force required increases substantially and starts to fluctuate wildly, and there are very many breakages of individual filaments and/or the yarn breaks as a whole.

Nor is this deterioration in the running behavior recoverable by a moderate change in the temperature of the preheater godet, for example upward or downward by 10° to 20° C.

However, it has now been found, surprisingly, that by raising this temperature a great deal, namely by from 40° to 70° C., above the most suitable temperature for drawing in the presence of spin finish it is possible to restore the drawing behavior in such a way that there is no longer any difference from the spin finish process.

In the process according to the invention, the choice of the most suitable godet temperature can be made from observing the drawing process, which should give trouble-free running over prolonged periods, or by measuring the number of snarls by means of commercially available measuring instruments. However, it is preferred, and more precise, to set the godet temperature sufficiently high that the drawing tension for the same draw ratio is the same as it was on drawing with spin finish application.

The process according to the invention thus permits at little expense the production of spin finish free fibers without complicated washing processes and indicates a way of avoiding the formation of unwanted spin finish vapors and deposits in drawing over heated godets.

The working examples which follow illustrate the practice of the process according to the invention in a comparison with the prior art.

EXAMPLE 1 (COMPARISON)

This comparative example describes the drawing of filaments made of an aromatic polyether ketone which in a conventional manner has been provided after spinning with a spin finish in that a commercially available aromatic polyether ketone (®Victrex PEEK from ICI) was spun into a multifilament yarn comprising 50 individual filaments and immediately following spinning wetted in a conventional manner with a spin finish comprising an emulsion of 6% by weight of mineral oil and 9% by weight of nonionic and anion-active emulsifiers in 85% by weight of water in such a way that about 1% (on weight of fiber) of nonaqueous spin finish constituents were present on the multifilament yarn.

The multifilament yarn thus spin-finished was drawn over a drawing means comprising 4 pairs of godets. Their circumferential speeds, temperatures and numbers of wraps are shown in Table 1:

TABLE 1

| | Speed (m/min) | Temperature (°C.) | Wraps |
|---|---|---|---|
| 1st pair of godets | 317.7 | 25 | 5 |
| 2nd pair of godets | 322.0 | 160 | 3 |
| 3rd pair of godets | 618.3 | 25 | 5 |
| 4th pair of godets | 615.5 | 25 | 5 |

Under these conditions, satisfactory drawing was possible. The drawn multifilament yarn had a tensile strength of about 27 cN/tex and an elongation at break of 40%.

EXAMPLE 2 (COMPARISON)

Comparative Example 1 was repeated, except that, instead of the spin finish used there, demineralized water only was applied to the filaments. With an unchanged setting on the drawing means, so many filament breakages occurred as to make continuous drawing impossible. Nor did an upward or downward change in the temperature of the second pair of godets by up to 20° C. produce any marked improvement in drawing.

EXAMPLE 3 (ACCORDING TO THE INVENTION)

Example 2 was repeated, except that the temperature of the second pair of godets was raised from 160° C. to 220° C. All other settings were retained.

Under these conditions it was again possible to obtain satisfactory drawing. The drawn multifilament yarn had a breaking strength of 28 cN/tex and an elongation at break of 41%.

EXAMPLE 4 (COMPARISON)

In this comparative example, the machine setting of Example 3 was retained, but the yarn was again spin-finished with the spin finish described in Example 1. Under these conditions it was again impossible to obtain continuous drawing, because the yarn lengthened on the second pair of godets, became stuck to the surface and broke.

Table 2 summarizes once more the essential conclusions of the Examples.

TABLE 2

| Example | Spin finish | Temperature of 2nd godet | Drawing |
|---|---|---|---|
| 1 (comparison) | conventional | 160° C. | good |
| 2 (comparison) | water | 160 ± 20° C. | impossible |
| 3 (invention) | water | 220° C. | good |
| 4 (comparison) | conventional | 220 ± 20° C. | impossible |

We claim:

1. A process for producing a spin-finish-free manmade fiber by melt spinning a high polymer having a glass transition temperature of about 100° C. and subsequently drawing the filaments by means of preheater godets to a previously determined draw ratio, whereby there is omitted, in said process, spin-finishing with a water solution or emulsion of, or minimal oil-borne, spin-finish agent which is a fiber-coating agent with emulsifying or anti-static or friction-reducing or interfilament adhesion-promoting or draw-promoting properties, which process comprises:

impinging the filaments prior to drawing with a liquid which can evaporate residuelessly during drawing, and selecting as the temperature of the preheater godet a temperature which is not less than 40° C. higher than that conventionally used after spin finishing, and evaporating said liquid during drawing to the point where essentially no residue of said liquid remains on the manmade fiber.

2. The process as claimed in claim 1, wherein the residuelessly evaporating liquid is essentially free of spin finish agents and comprises a liquid selected from the group consisting of water and an aliphatic compound of 2 to 8 carbon atoms containing a substituent selected from OH, an ether group, and combinations thereof.

3. The process as claimed in claim 1, wherein the residuelessly evaporating liquid consists essentially of water and is essentially free of spin finish agents.

4. The process as claimed in claim 1, wherein the temperature of the preheater godet is set not less than 50° C. above the glass transition temperature of said high polymer which is melt spun.

5. The process as claimed in claim 1, wherein the temperature of the preheater godet is set sufficiently high that the drawing tension for a given draw ratio corresponds to the ratio which would have been used if spin finishing had not been omitted and the preheater temperature were the same as that used in said spin finishing.

* * * * *